US008215868B2

(12) United States Patent
Bishop

(10) Patent No.: US 8,215,868 B2
(45) Date of Patent: Jul. 10, 2012

(54) HYDRAULIC POWERED BOAT PORTAGE APPARATUS

(76) Inventor: Richard B. Bishop, Bradenton, FL (US)

( * ) Notice: Subject to any disclaimer, the term of this patent is extended or adjusted under 35 U.S.C. 154(b) by 465 days.

(21) Appl. No.: 12/366,127

(22) Filed: Feb. 5, 2009

(65) Prior Publication Data

US 2009/0142135 A1 Jun. 4, 2009

Related U.S. Application Data

(63) Continuation-in-part of application No. 11/548,490, filed on Oct. 11, 2006, now abandoned.

(60) Provisional application No. 60/725,535, filed on Oct. 11, 2005.

(51) Int. Cl.
*B63C 3/06* (2006.01)

(52) U.S. Cl. ..... 405/3; 405/2; 212/330

(58) Field of Classification Search ..... 405/1–3; 212/328, 330

See application file for complete search history.

(56) References Cited

U.S. PATENT DOCUMENTS

| | | | | |
|---|---|---|---|---|
| 850,320 | A * | 4/1907 | Roeder | 405/86 |
| 3,101,149 | A * | 8/1963 | Hurst | 212/71 |
| 3,786,942 | A * | 1/1974 | Dane, Jr. | 414/266 |
| 4,190,013 | A * | 2/1980 | Otis et al. | 114/263 |
| 4,363,411 | A * | 12/1982 | Blair et al. | 212/308 |
| 4,976,211 | A * | 12/1990 | Reinhardt | 114/44 |
| 5,947,639 | A * | 9/1999 | Bishop et al. | 405/3 |
| 6,174,106 | B1 * | 1/2001 | Bishop et al. | 405/3 |
| 6,431,791 | B2 * | 8/2002 | Galluccio | 405/2 |

* cited by examiner

*Primary Examiner* — Tara Mayo-Pinnock

(74) *Attorney, Agent, or Firm* — Adam C. Underwood, Esq.; Carey Rodriguez Greenberg & O'Keefe, LLP

(57) ABSTRACT

A boat lift apparatus is disclosed. The boat lift apparatus includes a base structure having a first frame section erected over a barrier juxtaposed to a first body of water, the base structure having a second frame section that may be cantilevered over the first body of water and a lift frame operatively coupled with the base structure. The boat lift apparatus further includes a cradle assembly including at least one boat support for receiving a boat and carrying the boat across the barrier, the cradle assembly being moveably coupled to the lift frame. The boat lift apparatus further includes at least one hydraulic cylinder secured to the lift frame and operatively connected to the cradle assembly, wherein activation of the at least one hydraulic cylinder moves the cradle assembly up or down in the vertical direction.

18 Claims, 3 Drawing Sheets

HYDRAULIC POWERED BOAT PORTAGE APPARATUS

CROSS-REFERENCE TO RELATED APPLICATIONS

This utility patent application is a continuation-in-part of, and claims priority to, U.S. patent application Ser. No. 11/548,490 filed on Oct. 11, 2006 now abandoned, which claims priority to U.S. Provisional patent application Ser. No. 60/725,535 filed on Oct. 11, 2005. Application Ser. No. 11/548,490 and application Ser. No. 60/725,535 are incorporated herein by reference in their entirety. This utility patent application also incorporates by reference U.S. Pat. Nos. 6,457,904, 6,174,106 and 5,947,639.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of boat portage. More specifically, the embodiments of the present invention relate to a hydraulically powered apparatus for lifting a boat out of a body of water and transferring the boat horizontally over a barrier to another body of water or surface.

BACKGROUND OF THE INVENTION

In many areas, salt water and fresh water are separated by various types of barriers, such as water divider walls and land barriers. These barriers are often needed to separate fresh from salt water due to the various types of organisms, plants, and animals that can survive only in one type of environment, i.e., either in salt or in fresh water, but not both. Another purpose for these barriers is to separate a fresh water body from a salt water ocean, so as to protect the fresh water body from ocean tides, waves and currents. These barriers are especially necessary in cases where boats and other watercraft are stationed in the fresh water body. In some cases, a governmental authority may require such a barrier between fresh water bodies for environmental reasons. The aforementioned barriers, however, can pose an obstacle to boats and other watercraft that frequently require access between the two bodies of water.

The term "portage" refers to carrying a boat and/or its supplies overland from a first body of water, between two waterways or around an obstacle to navigation. Applicant's U.S. Pat. Nos. 6,457,904, 6,174,106, and 5,947,639 provide approaches to the problem of transferring boats over barriers, from one body of water to another. A lasting problem with such portage devices, however, involves the mechanism for lifting and lowering the boat in the vertical direction.

As seen in Applicant's aforementioned patents, the mechanism for lifting and lowering the boat in a vertical direction can involve the use of at least one or two vertically-positioned cables that are coupled to the lifting apparatus on the top end and coupled to the boat at the bottom ends. Upon activation of the lifting apparatus, a drum at the top end of the cable begins to spin, thereby gathering the length of the cables upon its cylindrical exterior surface and lifting the boat in a vertical direction. Although effective for lifting, this structure requires lengthy amounts of cable, numerous moving parts, an electrical-powered drum device that requires substantial amounts of current to operate and considerable maintenance. Furthermore, ball bearings, which are used in a drum-cable implementation described above, can be expensive, thereby increasing construction costs. Lastly, the motor and brakes needed in the drum-cable implementation require periodic maintenance, thereby increasing operating costs.

Therefore, a need exists to overcome the problems with the prior art as discussed above, and particularly for a more efficient way to portage a boat from one body of water to another.

SUMMARY OF THE INVENTION

Briefly, according to an embodiment of the present invention, a method for transporting a boat over a barrier between a first body of water and a second body of water is disclosed. The method includes positioning a moveable lift frame extending over the first body of water. The method further includes positioning into the first body of water the moveable cradle assembly coupled with the moveable lift frame and maneuvering a boat into the moveable cradle assembly. The method further includes extending a hydraulic cylinder coupled with the moveable cradle assembly, thereby raising the moveable cradle assembly to lift the associated boat out of the first body of water and to an elevation that is higher than the barrier and translating the boat across the barrier.

In another embodiment of the present invention, a boat lift apparatus is disclosed. The boat lift apparatus includes a base structure having a first frame section erected over a barrier juxtaposed to a first body of water, the base structure having a second frame section cantilevered over the first body of water and a lift frame operatively coupled with the base structure. The boat lift apparatus further includes a cradle assembly including at least one boat support for receiving a boat and carrying the boat across the barrier, the cradle assembly being moveably coupled to the lift frame. The boat lift apparatus further includes at least one hydraulic cylinder secured to the lift frame and operatively connected to the cradle assembly, wherein activation of the at least one hydraulic cylinder moves the cradle assembly in the vertical direction.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention solves problems associated with the prior art by providing a hydraulic powered boat portage apparatus and method for transporting a boat from one body of water, across a barrier, to another body of water. In contrast to the prior art described above, the apparatus and method of the present invention provides hydraulic powered movement of the boat in a vertical direction. The use of hydraulic power, as opposed to the mechanisms used by the prior art, comprises fewer moving parts, resulting in greater reliability and less maintenance of the boat portage apparatus. Additionally, the apparatus of the present invention utilizes less electricity than that of the prior art, thereby promoting energy efficiency. Lastly, the apparatus of the present invention requires lesser construction costs and affords longer periods before replacement is necessary, thereby reducing operating costs.

Figure 1:
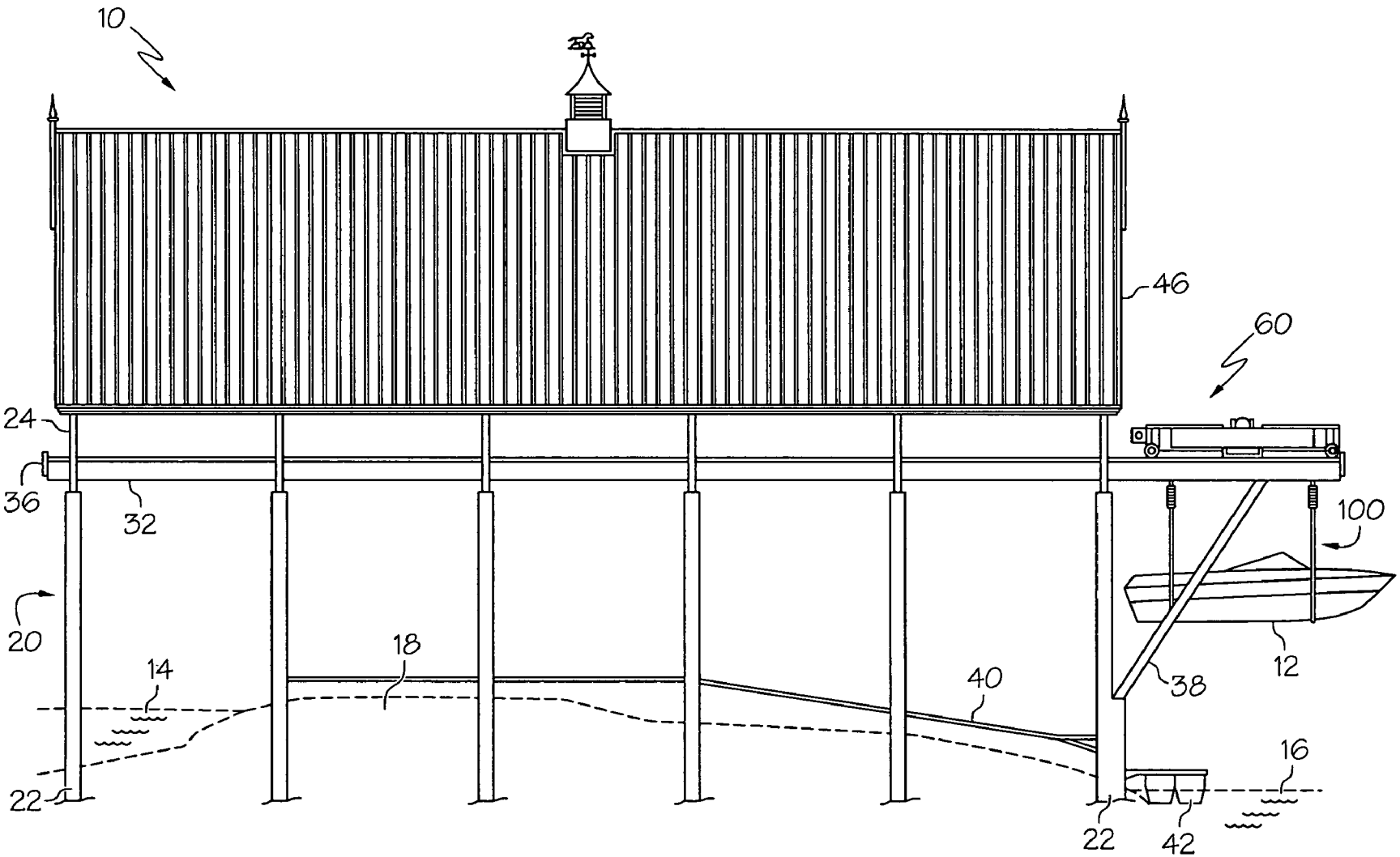
FIG. 1 is a side elevation view of the boat lift apparatus in accordance with the embodiments of the present invention.
Figure 2:
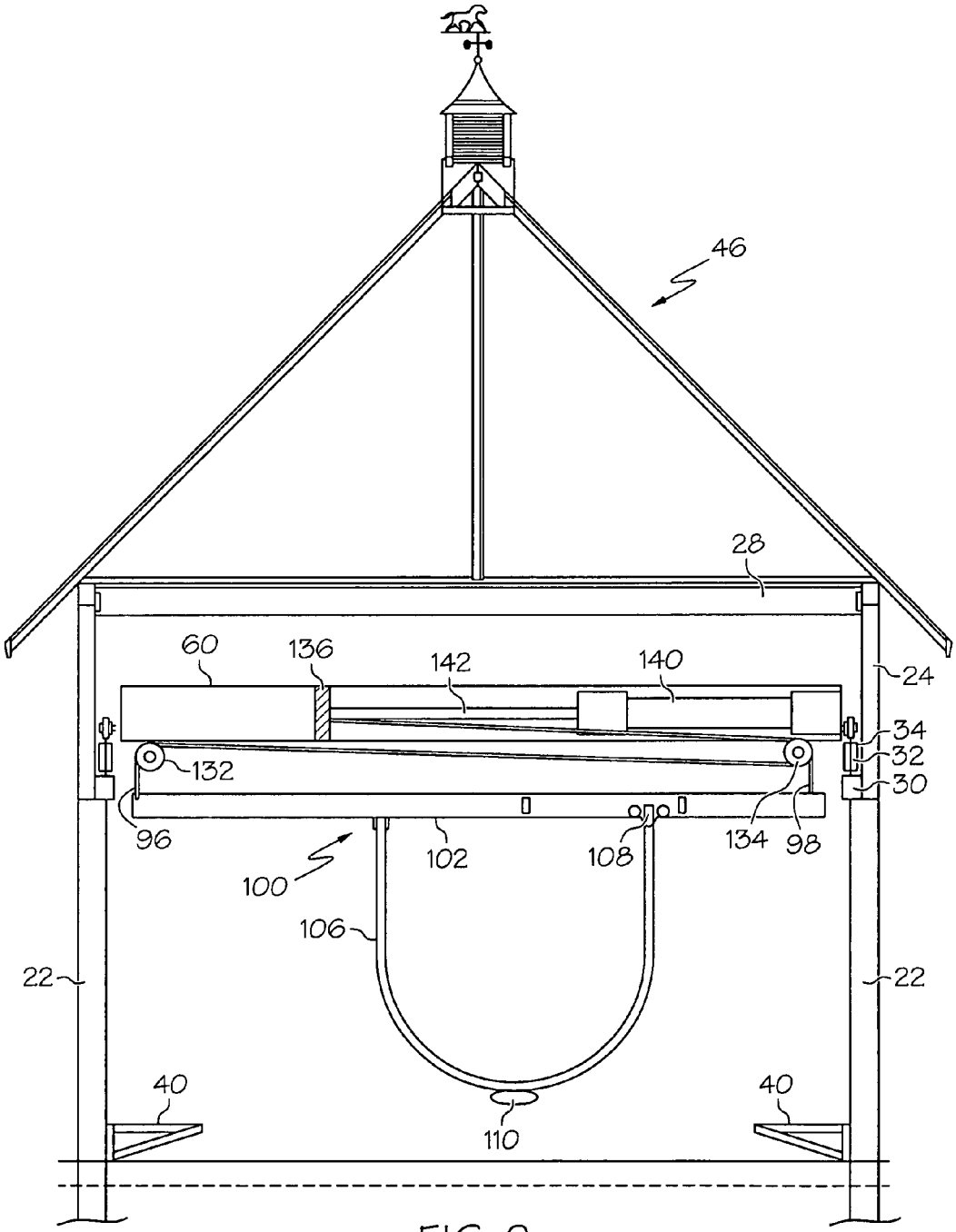
FIG. 2 is an end elevation view of the boat lift apparatus in accordance with the embodiments of the present invention.

Referring to FIGS. 1 through 2, boat lift 10 consists of a base structure 20, lift frame 60, and cradle assembly 100. Base structure 20 may include a plurality of piering members or columns 22 for supporting lift frame 60, which may be horizontally moveable. The lift frame 60 may serve as a support structure for the cradle assembly 100, which may be vertically moveable. Base structure 20 may be substantially rigid by, for example, anchoring the piering members or columns 22 to the earth. The base structure 20 may further include a guiding mechanism such as tracks or rails, rollers, or bearings. The lift frame 60 may be moveably connected to the guiding mechanisms for translating the lift frame 60 back and forth in a generally horizontal fashion over the base structure 20. In one embodiment, lift frame 60 rolls along tracks 34 of base structure 20, which is erected over a barrier 18 separating a first body of water 14 and a second body of water 16. "Bodies of water" may refer either to distinct bodies of water like, for example, the ocean and an inland waterway. "Bodies of water" may also refer to segments within a common body of water.

Figure 1A:
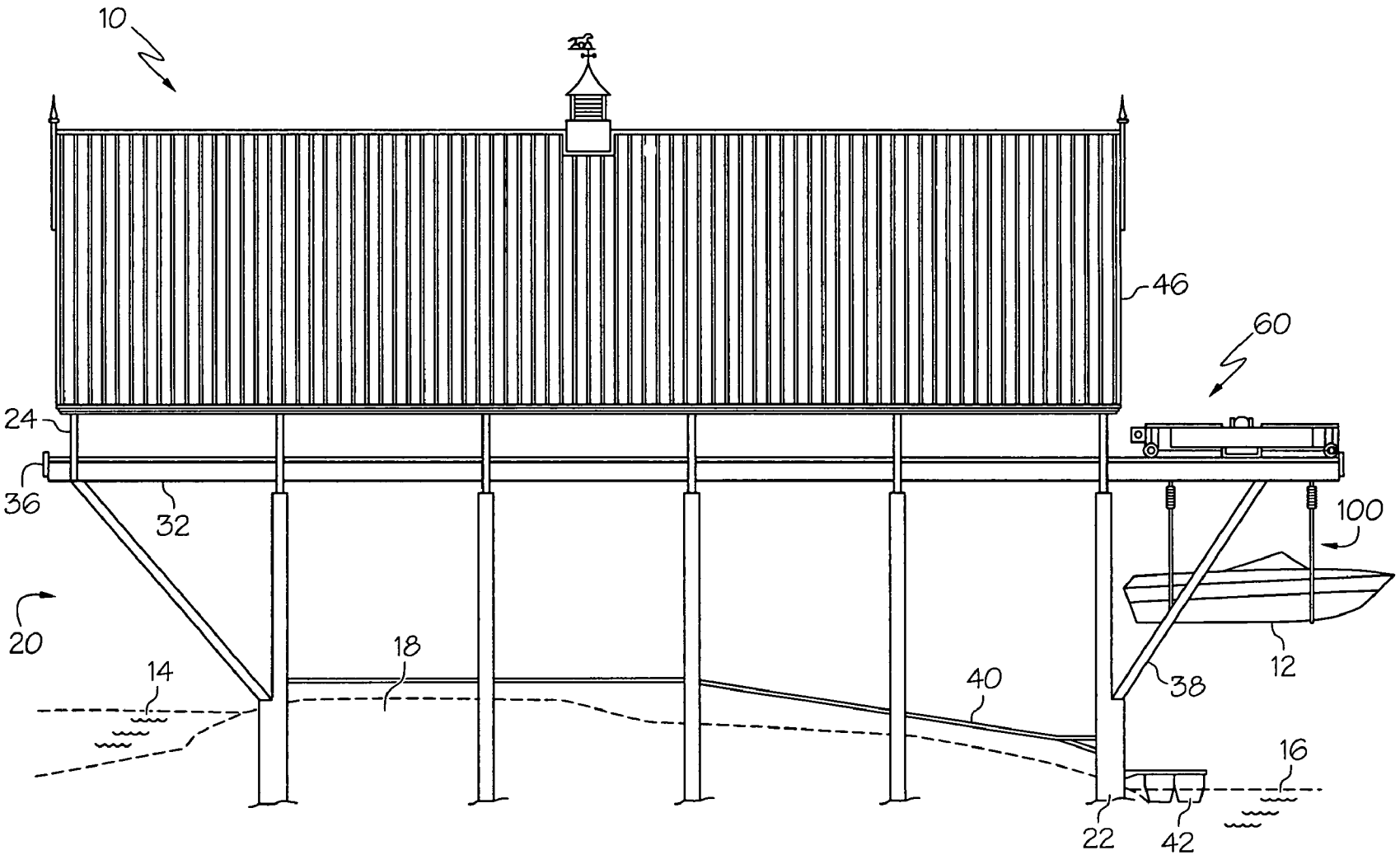
FIG. 1*a* is a side elevation view of the boat lift apparatus showing two cantilevered ends in accordance with the embodiments of the present invention.

In FIGS. 1 and 1*a*, boat 12 may be positioned next to either end of the boat lift 10 (i.e. in the first body of water 14 or in the second body of water 16). Accordingly, barrier 18, which may be a man-made or a natural barrier, can be located between the first body of water 14 and the second body of water 16. For example, many areas having both salt and fresh water bodies may need to prevent the two bodies of water from mixing, thereby contaminating the fresh water. Various types of organisms, plants, and animals can only survive in either salt or fresh water. Some barriers 18, such as raised land barriers, may occur naturally. Alternatively, persons or communities may construct barriers 18 to separate two bodies of water, such as during the construction of a fresh water lake or canal. One aspect to the existence of barriers 18 is that boats are prevented from freely traveling between nearby, but navigably unconnected, bodies of water. As such, boat lift 10 may portage a boat 12 between bodies of fresh and salt water, and/or it may portage boats 12 between bodies of fresh water or between bodies of salt water.

With continued reference to FIGS. 1 through 2, the base structure 20 may comprise concrete columns 22 driven into the earth, along with posts 24 to which are mounted cross members 28, track mounts 30, track support member 32, tracks 34, track stops 36, and/or cantilevered-end supports 38. Decking 40, docks 42, and roof 46 may also be included with the boat lift 10.

Posts 24 affixed atop columns 22 may extend in a substantially vertical direction. Still, it is contemplated that posts 24 may extend in other directions, including a vertically inclined angle, which may be angled for the purpose of intersecting a neighboring post 24. Generally, posts 24 provide for the attachment of a roof 46. Track 34 may comprise railroad track-like members which attach to track support member 32. Track mounts 30 secure track support member 32 to column 22. Stops 36 are mounted at the ends of track 34 to prevent lift frame 60 from over running track 34. Stops 36 may comprise a plate or angle joined to track 34 and/or track support member 32. In this manner, the base structure 20 may comprise a first frame section erected substantially over the barrier 18 and anchored to the columns 22.

When track 34, and its associated components, extends from a column 22 without connecting to another column 22, the track 34 becomes cantilevered. As shown in FIG. 1, the portion of the base structure 20 that extends cantilevered over the second body of water 16 may comprise a second frame section. Similarly, a third frame section may extend cantilevered over the first body of water 14, shown in FIG. 1*a*. Cantilevering may be desirable for saving costs, or when the underlying earth is not suitable for accepting columns 22, or when it is otherwise undesirable to utilize a concrete column 22. The cantilevered frame sections may also facilitate maneuvering of or docking of the boat 12 next to the barrier 18 in a sideways fashion as will be discussed below.

With reference to FIG. 2, the cradle assembly 100 may function to accept, carry, and release the boat 12. The cradle assembly 100 attaches to lift frame 60 via extendable supporting means such as tension-bearing cables 96, 98, which may comprise metal cable, rope, chains, polymeric fiber, composite strap, beams or rigid members. Accordingly, extending or retracting the supporting means will lower or raise the cradle assembly 100, respectively. As illustrated in FIG. 2, the cradle assembly 100 may comprise cradle support 102 and a boat-support mechanism 106, such as one or more boat slings 106. The cradle support 102 may be one or more horizontally positioned rigid steel beams.

The cable 96 runs from a first end of cradle support 102, through the wheel 132 mounted on lift frame 60, through the wheel 134 mounted on the lift frame 60 and to horizontally movable block 136. The cable 98 runs from the second end of cradle support 102, through the wheel 134 mounted on the lift frame 60 and to movable block 136. Lift frame 60 includes a horizontally positioned hydraulic cylinder 140, which further includes the horizontally actuated piston 142. Movable block 136 is securely mounted onto the end of piston 142. In this manner, extending piston 142 within hydraulic cylinder 140 extends the cables 96, 98, which lower the cradle assembly 100. Similarly, retracting piston 142 within hydraulic cylinder 140 retracts the cables 96, 98, which raise the cradle assembly 100. Hydraulic cylinder 140 may be one or more oil-based hydraulic cylinders activated by an oil pump via an oil line, one or more pneumatic cylinders activated by a pneumatic pump via a gas line or one or more electric cylinders activated via a power line.

In one embodiment, the boat-support mechanism 106 or boat sling 106 may be constructed of two straps 106 each having two ends connected to the cradle support 102. However, any number of straps 106 may be used to construct the boat sling 106. Each strap 106 may be affixed at opposing ends of the cradle supports 102 via pins, clips, bolts or other fasteners. In one embodiment, the straps 106 may be moveably connected to the cradle supports 102 by a movable constraint 108 such as a trolley, wherein the moveable constraint 108 is capable of translating along cradle support 102 to allow boat lift 10 to accommodate differently sized boats.

The boat slings 106 may be fabricated from high strength polyester that is resistant to damage from abrasion and deterioration from water exposure. The boat slings 106 may also be fabricated from materials offering similar wear resistance like that of nylon. Boat slings 106 may further be comprised of heavy gauge net which may be coupled to connectors at its extremities. Like the straps, such heavy gauge net may also be produced from nylon or high strength polyester. To assist the boat slings 106 in submerging rather than floating, weights 110 may be provided at the ends of boat slings 106. In one embodiment, weights 110 are sewn into packets provided in the boat slings 106. The cradle assembly 100 and/or the weights 110 may not retain water when the boat 12 is lifted out of the water.

With reference now to all of the Figures, in use the lift frame 60 of the boat lift 10 is positioned over the second body of water 16 thereby positioning the cradle assembly 100 over the second body of water 16 (see FIG. 1). The cradle assembly 100 may then be lowered into a position wherein the boat sling 106 and the corresponding weights 110 submerge beneath the water. It is noted here that track 34 is cantilevered over the second body of water 16 thereby allowing the boat sling 106 to be oriented so as to receive the boat 12. The boat 12 may be maneuvered to juxtapose the port or starboard sides of the boat 12 to the barrier 18 and the boat lift 10. The boat 12 may then be driven over the boat sling 106 for subsequent lifting and translating by the boat lift 10 in a manner consistent with the embodiments described herein. If straps 106 are used, at least one of the straps 106 can be adjusted to accommodate different length boats 12. The boat 12 may then be raised in a vertical direction by activation of the hydraulic cylinder 140, which raises up the cradle assembly 100 when the piston 142 is extended. Subsequently, cradle assembly 100 may be translated in a vertical direction over the barrier 18 by laterally moving the lift frame 60. During movement, the boat 12 may held at constant elevation above the surface of the barrier 18. Accordingly, the boat lift 10 may include a control unit that automatically adjusts the elevation of the cradle assembly 100 based upon one or more sensors, not shown. After the boat 12 is lifted and successfully translated over barrier 18, it can then be lowered into the first body of water 14 for navigation as desired in the first body of water.

The aforementioned constructions describe one embodiment for the lifting and portaging of a boat 12 in an essentially horizontal manner across a defined pathway. However, other translating means are also contemplated including alternate guiding and/or conveyance mechanisms, such as rollers, bearings, slides, or any other suitable conveyance means functionally equivalent to wheels.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A method for transporting a boat over a barrier between a first body of water and a second body of water, the method comprising the steps of:

positioning a moveable lift frame extending over the first body of water;

positioning into the first body of water a moveable cradle assembly comprising a cradle support and at least one boat support for receiving a boat, the moveable cradle assembly coupled with the moveable lift frame;

maneuvering a boat into the moveable cradle assembly;

providing a hydraulic cylinder comprising a cylinder base secured to the lift frame and a horizontally actuated piston secured to a horizontally moveable block of the moveable lift frame, the horizontally moveable block connected to the cradle support by a pair of cables, the hydraulic cylinder coupled with the moveable cradle assembly;

extending the horizontally actuated piston of the hydraulic cylinder coupled with the moveable cradle assembly, thereby raising the moveable cradle assembly to lift the boat out of the first body of water and to an elevation that is higher than the barrier; and translating the boat across the barrier.

2. The method as defined in claim 1, wherein the step of translating the boat across the barrier, comprises the step of:

laterally translating the boat with respect to the boat's forward direction of travel.

3. The method as defined in claim 1, further comprising the step of:

positioning the moveable lift frame and the boat over the second body of water; and retracting the hydraulic cylinder coupled with the moveable cradle assembly, thereby lowering the moveable cradle assembly to release the boat into the second body of water.

4. The method as defined in claim 3, further comprising the step of:

maneuvering the boat out of the moveable cradle assembly and into the second body of water.

5. The method as defined in claim 1, wherein the step of translating the boat across the barrier, comprises the step of:

horizontally moving the moveable lift frame, thereby translating the boat across the barrier.

6. The method as defined in claim 1, further comprising the step of:

providing a base structure having a moveable lift frame and a moveable cradle assembly.

7. A boat lift system comprising:

a barrier;

a first body of water juxtaposed to the barrier; and, a boat lift apparatus erected over the barrier, the boatlift apparatus comprising:

a base structure having a first frame section erected over the barrier juxtaposed to the first body of water, the base structure having a second frame section cantilevered over the first body of water;

a lift frame operatively coupled with the base structure;

a cradle assembly including a cradle support and at least one boat support for receiving a boat and carrying the boat across the barrier, the cradle assembly being moveably coupled to the lift frame; and at least one hydraulic cylinder comprising a cylinder base secured to the lift frame and a horizontally actuated piston secured to a horizontally moveable block of the lift frame, the horizontally moveable block connected to the cradle support by a pair of cables, wherein activation of the horizontally actuated piston of the at least one hydraulic cylinder moves the cradle assembly in the vertical direction.

8. The boat lift system as defined in claim 7, wherein the lift frame moves in a horizontal direction so as to traverse the second frame section when activated.

9. The boat lift system as defined in claim 8, wherein the barrier separates the first body of water from a second body of water, wherein the base structure includes a third frame section cantilevered over the second body of water and wherein the lift frame traverses the third frame section when activated.

10. The boat lift system as defined in claim 9, wherein the lift frame and the cradle assembly translate the boat across the barrier when activated.

11. The boat lift system as defined in claim 9, wherein the lift frame and the cradle assembly carry and release the boat into the second body of water when activated.

12. The boat lift system as defined in claim 8, wherein the lift frame includes a guiding mechanism comprising at least one of tracks, rollers, and bearings.

13. The boat lift system as defined in claim 8, wherein the second frame section extends entirely above the first body of water.

14. The boat lift system as defined in claim 8, wherein the at least one boat support comprises a non-water retaining boat sling connected to the lift frame.

15. The boat lift system as defined in claim 8, wherein the at least one boat support comprises a flexible non-water retaining boat sling connected to the lift frame.

16. The boat lift system as defined in claim 15, further comprising weights attached to the flexible non-water retaining boat sling.

17. The boat lift system as defined in 16, wherein the flexible non-water retaining boat sling are selectively adjustable in length.

18. The boat lift system as defined in claim 16, wherein the flexible non-water retaining boat sling includes a net for receiving the boat.

* * * * *